US009688522B2

(12) United States Patent
Song

(10) Patent No.: US 9,688,522 B2
(45) Date of Patent: Jun. 27, 2017

(54) MULTIFUNTIONAL ELECTRIC WINE OPENER

(71) Applicant: Zhuhai Kelitong Electronic Co., Ltd., Zhuhai (CN)

(72) Inventor: Xiaoxian Song, Guangdong Province (CN)

( * ) Notice: Subject to any disclaimer, the term of this patent is extended or adjusted under 35 U.S.C. 154(b) by 296 days.

(21) Appl. No.: 14/578,490

(22) Filed: Dec. 22, 2014

(65) Prior Publication Data

US 2016/0107871 A1 Apr. 21, 2016

(30) Foreign Application Priority Data

Oct. 17, 2014 (CN) ..... 2014 1 0549819

(51) Int. Cl.
*B67B 7/04* (2006.01)

(52) U.S. Cl.
CPC .... *B67B 7/0405* (2013.01); *B67B 2007/0458* (2013.01)

(58) Field of Classification Search
CPC .. B67B 7/04; B67B 7/0405; B67B 2007/0458
USPC ..... 81/3.2, 3.29
See application file for complete search history.

(56) References Cited

U.S. PATENT DOCUMENTS 5,351,579 A * 10/1994 Metz ..... B67B 7/0405 30/1.5
6,321,620 B1 * 11/2001 Fabbro ..... B67B 7/0405 81/3.09
6,658,739 B1 * 12/2003 Huang ..... B23D 21/08 30/101
6,752,041 B2 * 6/2004 Lee ..... B67B 7/0405 81/3.2
7,775,140 B2 * 8/2010 Chan ..... B67B 7/0441 81/3.29
8,667,867 B2 * 3/2014 Mills ..... B67B 7/0405 30/1.5

* cited by examiner

*Primary Examiner* — Hadi Shakeri
(74) *Attorney, Agent, or Firm* — Prakash Nama; Global IP Services, PLLC

(57) ABSTRACT

A multifunctional electric wine opener having an opener holder in an upper part of an opener cover, an upper lid of the opener embedded in an opening position of the opener holder, a guide spring and a guide frame assembled in a holder containing cavity, at least two guide paths provided on the guide frame, blade units assembled in the guide paths, a blade holder and an opening blade provided in each blade unit, a horizontal installation unit and a vertical installation unit provided in each blade holder; the opening blade being set in the upper part of the vertical installation unit and the horizontal installation unit being inserted into a corresponding guide path, travel springs assembled in the guide paths, holder guide slopes set on inner surfaces of holder containing cavity.

7 Claims, 4 Drawing Sheets

MULTIFUNTIONAL ELECTRIC WINE OPENER

BACKGROUND OF THE INVENTION

This invention relates to the technical field of wine set, especially to a multifunctional electric wine opener.

With the advancement of people's living standards, drinking wine has become a lifestyle for more and more consumers. Due to the special package structure of wine, we should remove the tinfoil at the bottle finish then pull out the stopper firmly embedded in the finish. The current general technology is to remove the tinfoil at the bottle finish manually, which is wasting time and energy as well as inconvenient, as the tinfoil closely fit the bottle finish.

Wine opener is a aided tool to pull out the stopper from bottle finish. General wine opener is often consist of the hand-held body for operator and a screw hook connected to the body, The operator shall hold and rotate the body to screw the hook into the stopper then to pull out the stopper from the bottle to complete the opening. However, there are several defects for the above mentioned opener in actual utilization. For instance, the operator have to put the bottle underneath the screw hook and locate the hook along the axis of the stopper, then hold the bottle with the left hand while rotate the body and screw the hook into the stopper. Besides, only when the stopper rotate towards the finish can the operator pull out the stopper, by wasting time and energy and bringing inconvenience.

BRIEF SUMMARY OF THE INVENTION

This invention aims to provide a multifunctional electric wine opener regarding the deficiencies of current technology featuring with novel structure design and easy to use, which on one hand realizes the wine opening automatically and easily and on the other hand cuts the tinfoil at the bottle finish conveniently and swiftly on the other hand for the operator's convenience to remove tinfoil.

This invention applies technical solutions below to realize the above aims.

A multifunctional electric wine opener includes the opener cover, the knife holder set in the upper part of the cover, the containing cavity for holder with an opening up formed in the core part of the holder, the upper lid embedded at the opening position of the containing cavity, the guide frame set in the lower part of upper lid in the containing cavity which allows up-and-down motions, the guide spring located at the lower part of the guide frame, the contact between the upper part of guide spring and the lower part of guide frame, and the contact between the lower part of guide spring and the bottom of holder containing cavity;

At least two guide path set on the guide frame which lay in circular ring shape with evenly spaces and which of each has an side opening, the blade components assembled to each guide path of the guide frame, the "L" shape blade holder of each blade component, horizontal installation unit extending horizontally and vertical installation unit extending vertically which is integrally formed with the former, the opening blade set separately on the upper part of vertical installation unit that stretching to the upper part of the guide frame, the insertion of each horizontal installation unit into each guide path, the travel spring assemble in each guide path, the contact between two ends of each travel spring and the corresponding horizontal installation unit and the bottom of guide path;

The guide slope of holder set to each blade holder on the inner surface of containing cavity of the opener holder, the inwards sloping of the guide slope of holder stretching from up-to-down, the guide slope of blade holder which is corresponding to the guide slope of holder, the contact between guide slope of each blade holder and the corresponding guide slope of holder;

There are the shell containing cavity formed in the core part of opener cover, the electric opener unit embedded in the shell containing cavity.

Among them, the above electric opener unit shall includes the opener sleeve, screw hook, reduction gear box and opener drive motor successively in down-to-up order. The power take-off shaft of the drive motor, reduction gear box and screw hook drives the adapter in sequences. While, the opener sleeve structure has a assembly hole which matches bottle finishes and the head of screw hook is inserted into the assembly hole of opener sleeve.

Among them, the above electric opener unit shall also include rechargeable battery which is electrically connected to the above mentioned opener drive motor.

Among them, the above shell containing cavity shall also be assembled with switch controlled PCB (printed circuit board). The rechargeable battery, switch controlled PCB and opener drive motor shall be electrically connected in sequence. There shall be opener switch set on the switch controlled PCB of the opener cover.

Among them, the shell containing cavity shall also be assembled with charger controlled PCB which is electrically connected to rechargeable battery. There shall be a charging connector on the charger controlled PCB corresponding to the lower part of shell containing cavity. The upper part of charging connector and the charger controlled PCB shall be electrically connected and a charging contact piece shall be set in the lower part of charging connector.

Among them, the blade embedding groove shall be set on the upper surface of vertical installation unit of each blade holder when the lower part of each opener blade is inserted into the corresponding embedding groove.

Among them, the spring embedding groove towards the side opening of the above guide frame shall be set in the horizontal installation unit of each blade holder. The two ends of each travel spring shall contact the bottom of corresponding spring embedding groove and that of guide path.

The beneficial effect of this invention are: the described multifunctional electric wine opener in this invention which has a opener holder set in the upper part of the opener cover, a upper lid of opener embedded in the opening position of the opener holder, guide spring and guide frame assembled in order in the holder containing cavity, at least two guide paths on the guide frame, blade unit assembled in guide path, blade holder and opening blade in blade unit, horizontal installation unit and vertical installation unit in blade holder, when the opening blade is set in the upper part of vertical installation unit and the horizontal installation unit is inserted into the guide path, travel spring assembled in guide path, holder guide slope set on the inner surface of holder containing cavity, the guide slope of blade holder, the electric opener unit assembled in shell containing cavity. On one hand, the above structure design enables the wine opening in a automatic and easy way. On the other hand, it enables the operator to cut the tinfoil at the bottle finish conveniently and swiftly to remove the tinfoil. It is featured with novel structure design and is easy to use.

BRIEF DESCRIPTION OF THE DRAWINGS

Below is the further description of this invention through figures, while the implementation cases in the figures shall not bring any restriction to this invention.

Figure 1:
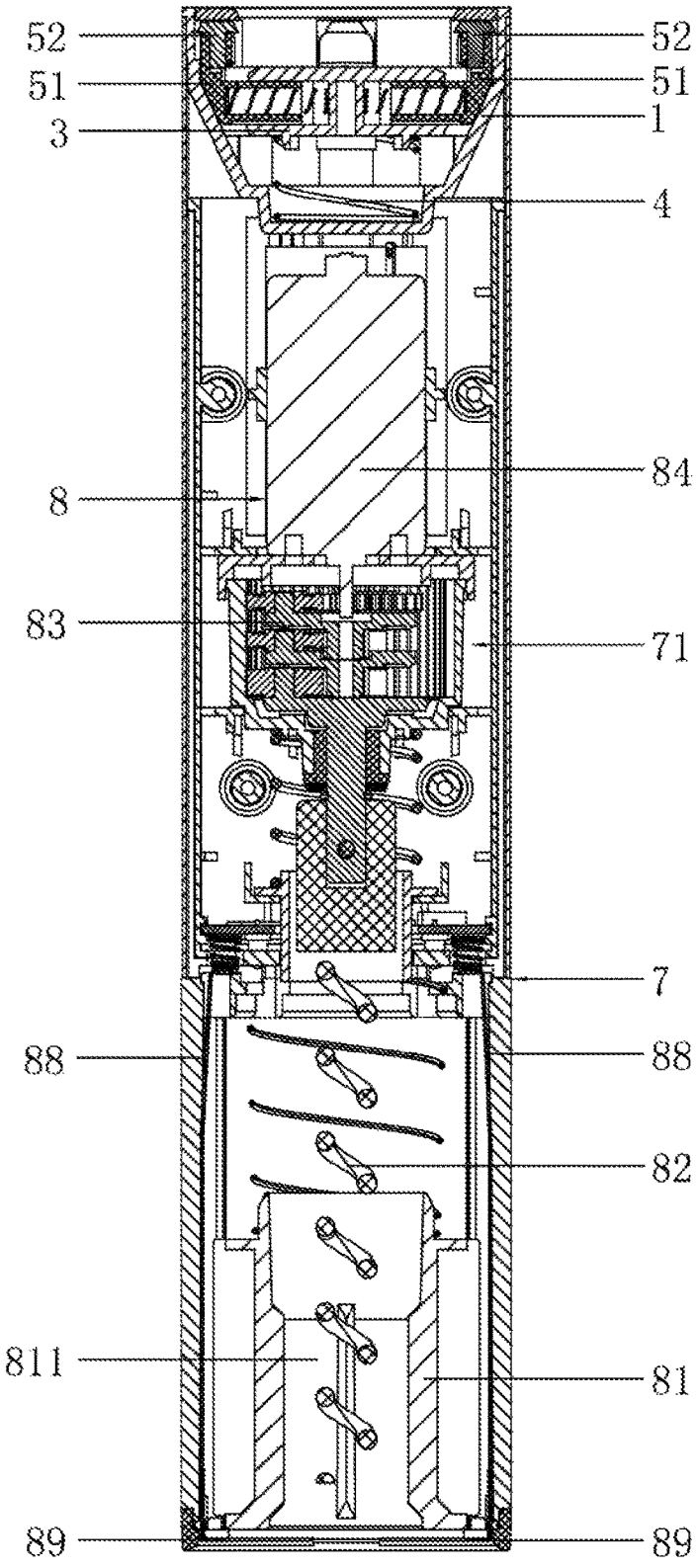
FIG. 1 The overall profile sketch

The following items are included in FIG. 1 to FIG. 4:

| | |
|---|---|
| 1—opener holder | 11—holder containing cavity |
| 12—holder guide slope | 2—Upper lid of opener |
| 3—guide frame | 31—guide path |
| 4—guide spring | 5—blade component |
| 51—blade holder | 511—horizontal installation unit |
| 511a—spring embedding groove | 512—vertical installation unit |
| 512a—blade embedding groove | 513—guide slope of blade holder |
| 52—opening blade | 6—travel spring |
| 7—opener cover | 71—shell containing cavity |
| 8—electric opener unit | 81—opener sleeve |
| 811—assembly hole | 82—screw hole |
| 83—reduction gear box | 84—opener drive motor |
| 85—rechargeable battery | 86—switch controlled PCB |
| 86—control switch | 87—charger controlled PCB |
| 88—charging connector | 89—charging contact piece |

DETAILED DESCRIPTION OF THE INVENTION

Below is the further description of this invention through specific implementation ways.

As shown in FIG. 1 to FIG. 4, a multifuncational electric wine opener includes opener cover 7, the knife holder 1 set in the upper part of the cover 7, the containing cavity for holder 11 with an opening up formed in the core part of the holder 1, the upper lid 2 embedded at the opening position of the containing cavity 11, the guide frame 3 set in the lower part of upper lid 2 in the containing cavity 11 which allows up-and-down motions, the guide spring 4 located at the lower part of the guide frame 3, the contact between the upper part of guide spring 4 and the lower part of guide frame 3, and the contact between the lower part of guide spring 4 and the bottom of holder containing cavity 11.

Among them, at least two guide path 31 set on the guide frame 3 which lay in circular ring shape with evenly spaces and which of each has an side opening, the blade components 5 assembled to each guide path 31 of the guide frame 3, the "L" shape blade holder 51 of each blade component 5, horizontal installation unit 511 extending horizontally and vertical installation unit 512 extending vertically which is integrally formed with the former 511, the opening blade 52 set separately on the upper part of vertical installation unit 512 that stretching to the upper part of the guide frame 3, the insertion of each horizontal installation unit 511 into each guide path 31, the travel spring 6 assembled in each guide path 31, the contact between two ends of each travel spring 6 and the corresponding horizontal installation unit 511 and the bottom of guide path 31.

Furthermore, the guide slope 12 of holder 1 set to each blade holder 51 on the inner surface of containing cavity 11 of the opener holder 1, the inwards sloping of the guide slope 12 of holder stretching from up-to-down, the guide slope 513 of blade holder 51 which is corresponding to the guide slope 12 of holder 1, the contact between guide slope 513 of each blade holder 51 and the corresponding guide slope 12 of holder 1.

Besides, there are the shell containing cavity 71 formed in the core part of opener cover 7 and the electric opener unit 8 embedded in the shell containing cavity 71.

During using the invention to cut tinfoil, the operator shall keep the containing cavity 11 of the opener holder 1 in line with the position of the bottle finish underneath, and press down the opener holder 1 when the bottle finish pushes the guide frame 3 towards guide spring to compress the guide spring 4. Meanwhile, the guide frame 3 moves towards the bottom of holder containing cavity 11 of the opener holder 1, and the guide frame 3 leads blade holder 51 and opening blade 52 to move towards the bottom of holder containing cavity 11. Since the guide slope of each holder 12 is matching with corresponding guide slope 513 of blade holder 51, each of guide slope 513 of blade holder 51 moves towards the guide slope 12 of holder 1. At this time, each blade holder 51 moves inwards under the guide pushing of corresponding guide slope 12 of holder 1, and the horizontal installation unit 511 of each blade holder 51 is gradually pushed into the guide path 31 of corresponding guide frame 3 and each travel spring 6 is compressed. While the vertical installation unit 512 of each blade holder 51 leads corresponding opening blade 52 to move inwards gradually to eventually make each opening blade 52 to contact and tightly hold the tinfoil at the bottle finish so that each opening blade 52 cuts the tinfoil. After the cutting, the operator shall lift the opener holder 1 and pull the upper lid 2 of the opener away from the finish so the guide frame 3 and each blade holder 51 are back to reset under the reset elastic force of travel spring 6 and guide spring 4.

The opener holder 1 in this invention can be installed in the upper part of opener cover 7 with screw joint. Besides, the electric opening unit 8 in the shell containing cavity 71 can pull out the stopper from the bottle automatically.

For the above situation, through the structure design described above, the invention is featured with novel structure design and easy to use, which on one hand realizes the wine opening automatically and easily and on the other hand cuts the tinfoil at the bottle finish conveniently and swiftly on the other hand for the operator's convenience to remove tinfoil.

Figure 2:
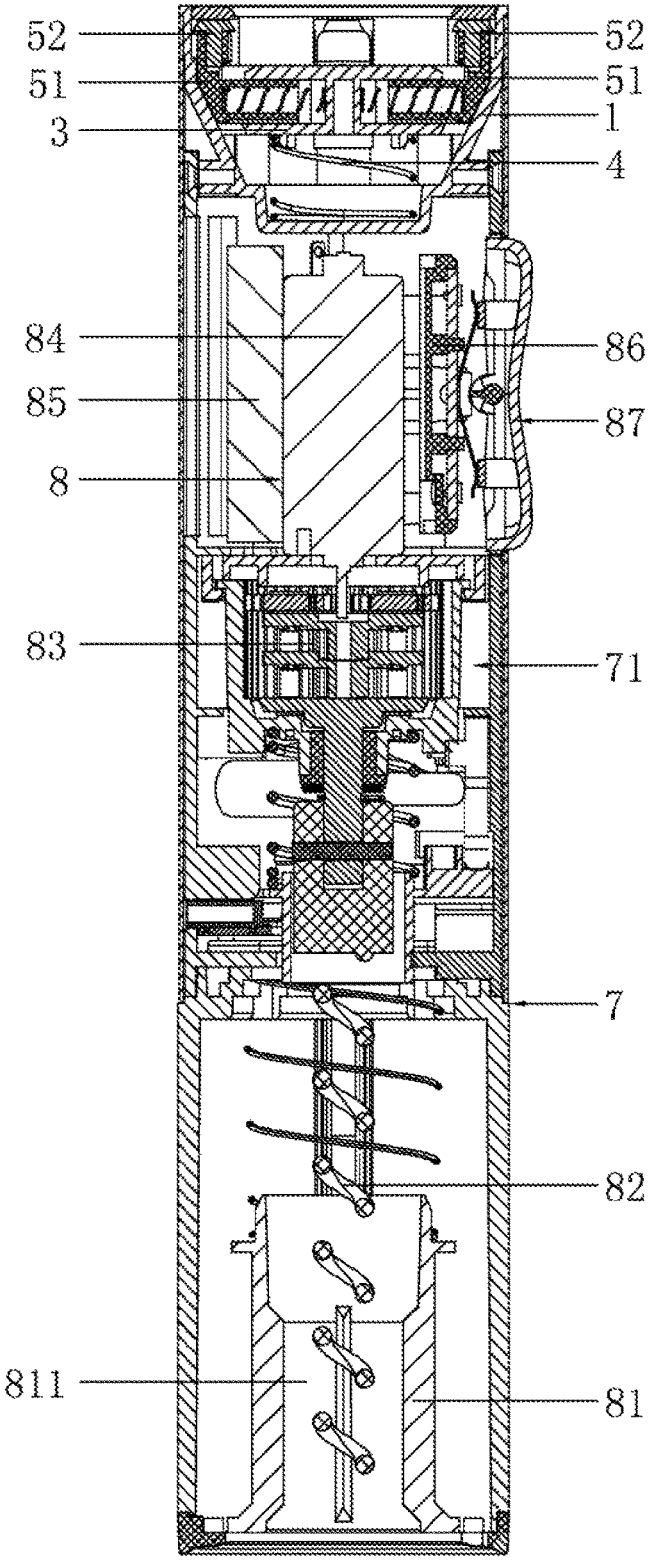
FIG. 2 The overall profile sketch from another side

As the optimum implementation as shown in FIG. 1 and FIG. 2, the electric opener unit 8 shall includes the opener sleeve 81, screw hook 82, reduction gear box 83 and opener drive motor 84 successively in down-to-up order. The power take-off shaft of the drive motor 84, reduction gear box 83 and screw hook 82 drives the adapter in sequences. While, the opener sleeve 81 structure has a assembly hole 811 which matches bottle finishes and the head of screw hook 82 is inserted into the assembly hole 811 of opener sleeve 81.

During the opening through this invention, the operator shall align the assembly hole 811 of opener sleeve 81 to the position of bottle finish then start the opener drive motor 84. With the help of reduction effect of reduction gear box 83, the drive motor 84 slowly drives the screw hook 82 to rotate which inserts into the stopper and finally pull it out.

The electric opener unit 8 shall also include rechargeable battery 85 which is electrically connected to the above mentioned opener drive motor 84. For the better control of opening operation, the shell containing cavity 71 in this invention shall also be assembled with switch controlled PCB (printed circuit board). The rechargeable battery 85, switch controlled PCB and opener drive motor 84 shall be electrically connected in sequence. There shall be opener switch 861 set on the switch controlled PCB of the opener cover 7. During the working course, the rechargeable battery 85 supplies power to opener drive motor 84, and the switch controlled PCB and control switch 861 work cooperatively to control the corotation and inversion of drive motor 84 so as to control the pulling out and dropping off of the stopper.

The shell containing cavity 71 shall also be assembled with charger controlled PCB 87 which is electrically connected to rechargeable battery 85. There shall be a charging connector 88 on the charger controlled PCB 87 corresponding to the lower part of shell containing cavity 71. The upper part of charging connector 88 and the charger controlled PCB 87 shall be electrically connected and a charging contact piece 89 shall be set in the lower part of charging connector 88. The charging contact piece can work with corresponding charging dock.

Figure 3:
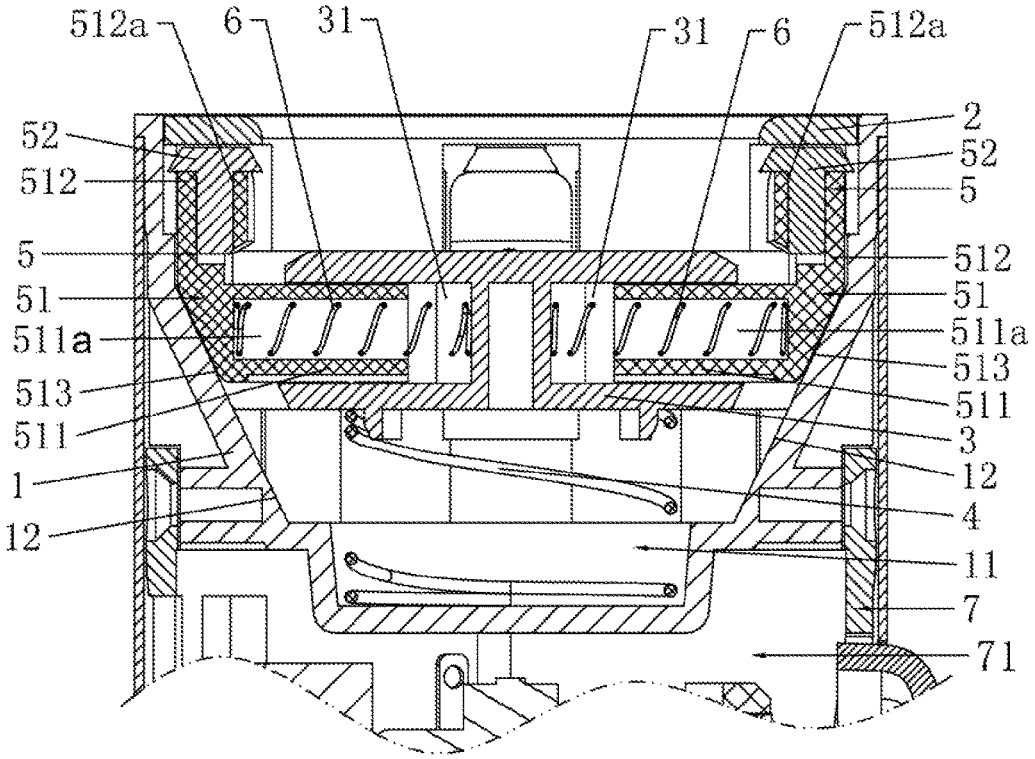
FIG. 3 The local section sketch
Figure 4:
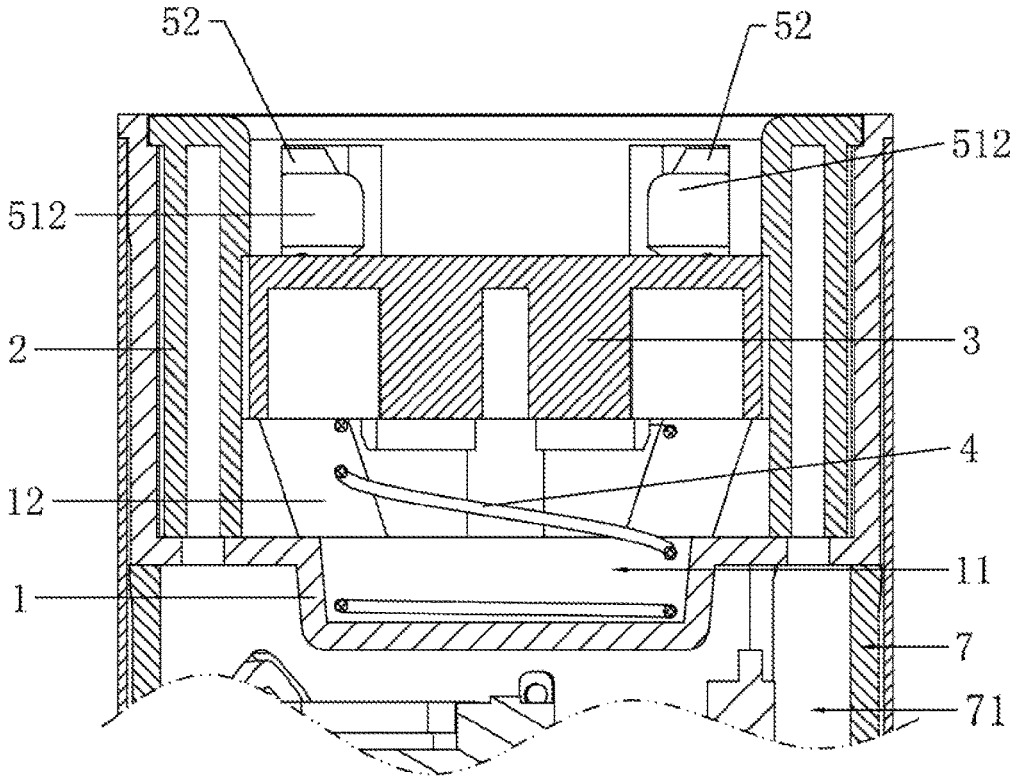
FIG. 4 The local section sketch from another side

As the optimum implementation as shown in FIG. 3, the blade embedding groove 512*a* shall be set on the upper surface of vertical installation unit 512 of each blade holder 51 when the lower part of each opener blade 52 is inserted into the corresponding embedding groove 512*a*. Except of the embedding methods above to complete the assembly, the opener blade 52 also can apply other assembly means to connect with the vertical installation unit 512.

As an optimum implementation as shown in FIG. 3, the spring embedding groove 511*a* towards the side opening of the above guide frame 3 shall be set in the horizontal installation unit 511 of each blade holder 51. The two ends of each travel spring 6 shall contact the bottom of corresponding spring embedding groove 511*a* and that of guide path 31. The travel spring 6 can be installed swiftly when a spring embedding groove 511*a* is set in the horizontal installation unit.

The above content is only about the better implementation cases of the invent. General technicians of this field may make modifications to the specific implementation way or application range according to the concept of the invention. The content in this description shall not be interpreted as a restriction of the invention.

What is claimed is:

1. A multifunctional electric wine opener comprising:

an opener cover (7) defining an upper part, a middle part and a lower part;

a knife holder (1) positioned in the upperpart of the opener cover, the knife holder including a containing cavity (11) with an upper open end;

an upper lid (2) embedded at the open end of the containing cavity;

a guide frame (3) set within the containing cavity under a lower part of the upper lid and arranged for up-and-down motions relative to the knife holder;

a guide spring (4) located at a lower part of the guide frame, the spring having a first upper part contacting the lower part of the guide frame and a second lower part contacting a bottom of the containing cavity defined by the holder;

at least two guide paths (31) set on the guide frame, the guide paths lay in a circular ring shape with evenly spaces and each of which has a side opening;

a blade component (5) assembled to each guide path of the guide frame;

each blade component including an L-shaped blade holder (51) defining a horizontal installation unit (511) extending horizontally and a vertical installation unit (512) extending vertically and integrally formed with the horizontal installation unit;

each blade component further including an opening blade (52) set separately on an upper part of the vertical installation unit that stretches to an upper part of the guide frame and each horizontal installation unit inserted into a corresponding guide path;

a travel spring (6) assembled in each guide path one end of each travel sarin contacting a corresponding inserted horizontal installation unit and another end of each travel spring contacting a corresponding bottom of the corresponding guide path;

each blade holder defining a guide slope (513) contacting a corresponding guide slope (12) formed on an inner surface of the containing cavity, wherein each guide slope of the knife holder slopes inwardly from an upper part to a lower part of the containing cavity and wherein each of the guide slope of the blade holder corresponds to the slope of each of the guide slope of the knife holder; and a shell containing cavity (71) formed in the middle part of the opener cover and an electric opener unit (8) embedded in the shell containing cavity.

2. The multifunctional electric wine opener according to claim 1, wherein the electric opener unit successively in down-to-the order includes, an opener sleeve (81), a screw hook (82), a reduction gear box (83), and an opener drive motor (84) having a drive shaft, wherein the opener sleeve structure has an assembly hole (811) for engaging a bottle neck and the head of screw hook is inserted into the assembly hole of the opener sleeve.

3. The multifunctional electric wine opener according to claim 2, wherein the electric opener unit further includes a rechargeable battery (85) which is electrically connected to the opener drive motor.

4. The multifunctional electric wine opener according to claim 3, wherein the shell containing cavity further contains a switch controlled PCB, wherein the rechargeable battery, the switch controlled PCB and the opener drive motor (84) are electrically connected in sequence and wherein an opener switch (861) is set on the switch controlled PCB.

5. The multifunctional electric wine opener according to claim 4, wherein the shell containing cavity further contains a charger controlled PCB (87) which is electrically connected to the rechargeable battery, the charger controlled PCB including a charging connector (88) positioned on a lower part of the shell containing cavity, wherein an upper part of the charging connector and the charger controlled PCB are electrically connected and wherein a charging contact piece (89) is set in a lower part of the charging connector.

6. The multifunctional electric wine opener according to claim 5, further comprising a corresponding blade embedding groove (512*a*) formed on an upper surface of each of the vertical installation unit of each blade holder, wherein a lower part of each opener blade is inserted into the corresponding embedding groove.

7. The multifunctional electric wine opener according to claim 6, wherein a spring embedding groove (511*a*) is set in each of the horizontal installation unit, wherein the two ends of each travel spring contacts a bottom of corresponding spring embedding groove and that of guide path.

* * * * *